US011161152B2

(12) United States Patent
Zhu et al.

(10) Patent No.: US 11,161,152 B2
(45) Date of Patent: Nov. 2, 2021

(54) RADIX CODCNOPSITIS PILOSULAS SORTING AND THREADING MACHINE

(71) Applicant: JiangXi University of Science and Technology, Ganzhou (CN)

(72) Inventors: Hua Zhu, Ganzhou (CN); Zhizhang Chen, Ganzhou (CN); Haiqiang Hu, Ganzhou (CN)

(73) Assignee: Jiangxi University of Science and Technology, Ganzhou (CN)

( * ) Notice: Subject to any disclaimer, the term of this patent is extended or adjusted under 35 U.S.C. 154(b) by 22 days.

(21) Appl. No.: 16/829,373

(22) Filed: Mar. 25, 2020

(65) Prior Publication Data

US 2020/0331030 A1 Oct. 22, 2020

(30) Foreign Application Priority Data

Apr. 16, 2019 (CN) ..... 201910303307.1

(51) Int. Cl.
*B07B 13/04* (2006.01)
*B07B 13/16* (2006.01)
*F26B 9/10* (2006.01)

(52) U.S. Cl.
CPC ..... *B07B 13/04* (2013.01); *B07B 13/16* (2013.01); *F26B 9/10* (2013.01)

(58) Field of Classification Search
CPC ..... B07B 13/04; B07B 13/16; B07B 13/14; B07B 13/065; B07B 13/07; B07B 13/075; B07B 1/22; F26B 9/10
USPC ..... 209/244, 296
See application file for complete search history.

(56) References Cited

U.S. PATENT DOCUMENTS 2,303,222 A * 11/1942 Murray ..... B07B 1/22 209/44.1
2006/0113224 A1* 6/2006 Williamson ..... B07B 13/04 209/615

FOREIGN PATENT DOCUMENTS

CN 104368519 A * 2/2015 ..... B07B 1/4609

OTHER PUBLICATIONS

Zhao, Ke-lin, "Tea Classifying Mechanism" (English Translation), Feb. 25, 2015, worldwide.espacenet.com (Year: 2015).*

* cited by examiner

*Primary Examiner* — Joseph C Rodriguez
*Assistant Examiner* — Molly K Devine
(74) *Attorney, Agent, or Firm* — Slater Matsil, LLP

(57) ABSTRACT

The present disclosure relates to a Radix Codcnopsitis Pilosulas sorting and threading machine that rapidly sorts and automatically threads a Radix Codcnopsitis Pilosulas into a string. The Radix Codcnopsitis Pilosulas sorting and threading machine includes a bottom plate, a support leg, a mounting frame, an N-shaped frame, a feeding hopper, a baffle, a first roller, a first conveyor belt, a drive motor, a deep groove ball bearing and a spindle, where the mounting frame is fixedly mounted on the bottom plate through the support leg, the N-shaped frame is mounted on an upper left side of the mounting frame, the feeding hopper is mounted in the top of the mounting frame, two first rollers are rotatably mounted on an upper part of the mounting frame, and a first roller on the right is higher than a first roller on the left.

8 Claims, 4 Drawing Sheets

RADIX CODCNOPSITIS PILOSULAS SORTING AND THREADING MACHINE

CROSS-REFERENCE TO RELATED APPLICATIONS

This application claims priority to Chinese Application No. 201910303307.1, filed on Apr. 16, 2019, which is incorporated herein by reference in its entirety.

TECHNICAL FIELD

The present disclosure relates to a threading machine, and in particular, to a Radix Codcnopsitis Pilosulas sorting and threading machine.

BACKGROUND

Radix Codcnopsitis Pilosulas is a unique Chinese medicinal material, originated from Shanxi Shangdang. As a commonly used Chinese medicine, Radix Codcnopsitis Pilosulas has many varieties, such as Xi Dang, mainly produced in Gansu, Shanxi and Sichuan provinces, etc.; Dong Dang, mainly produced in northeast China; and Lu Dang, mainly produced in Shanxi and Henan provinces, etc. They all have large demand and output.

Radix Codcnopsitis Pilosulas is generally harvested in the fall two years after transplanting, and some are harvested three or four years later. It is cured by: dig out, cut off vines, remove the soil, spread on a drying ground, dry to 30% to 40% flat and soft, select by hand according to size, knead by hand on a wooden board, and dry. This process is repeated 3-4 times till a Radix Codcnopsitis Pilosulas is dry. In rainy areas in south China, Radix Codcnopsitis Pilosulas is dried by charcoal fire at a temperature of about 60° C. During drying, codonopsis is turned frequently and kneaded until it is soft. The process is repeated several times until the Radix Codcnopsitis Pilosulas is completely dry. The purpose of kneading is to straighten the root for even drying, so that the Radix Codcnopsitis Pilosulas tastes firm and tender. Radix Codcnopsitis Pilosulas is long cylindrical and slightly curved, 10-35 cm long and 0.4-2 cm in diameter. Generally, 2 kg of fresh Radix Codcnopsitis Pilosulas is cured into 1 kg of dried codonopsis, with a yield of 250-400 kg dried codonopsis per mu, and even 500 kg per mu.

With such a huge yield, all provinces in China are still adopting manual threading for drying, which takes a long time and requires a lot of manpower. Therefore, to improve production efficiency and reduce labor costs, an automatic threading machine is needed to replace manual threading.

SUMMARY OF THE INVENTION

These and other problems are generally solved or circumvented, and technical advantages are generally achieved, by embodiments of the present disclosure which provide a Radix Codcnopsitis Pilosulas sorting and threading machine to rapidly screen and automatically thread a Radix Codcnopsitis Pilosulas.

In order to overcome the shortcomings of the current manual threading which takes a long time and requires a lot of manpower, the present disclosure provides a Radix Codcnopsitis Pilosulas sorting and threading machine to rapidly screen and automatically thread a Radix Codcnopsitis Pilosulas.

The present disclosure has the following technical solution: a Radix Codcnopsitis Pilosulas sorting and threading machine includes: a bottom plate, a support leg, a mounting frame, an N-shaped frame, a feeding hopper, a baffle, a first roller, a first conveyor belt, a drive motor, a deep groove ball bearing, a spindle, a cylindrical gear, a screening device, a guiding device, a transparent plate, a conveyor, a mechanism case, a first mounting plate, a first bearing seat, a first drive shaft, a second bearing seat, a second drive shaft, a big pulley, a small pulley, a flat belt, a servo motor, a first gear, a second mounting plate, a third bearing seat, a third drive shaft, a second gear, a third gear, a fourth bearing seat, a fourth drive shaft, a fourth gear, a first rotating motor and an electric threading machine. The mounting frame is fixedly mounted on the bottom plate through the support leg. The N-shaped frame is mounted on an upper left side of the mounting frame. The feeding hopper is mounted in the top of the mounting frame. Two first rollers are rotatably mounted on an upper part of the mounting frame. A first roller on the right is higher than a first roller on the left. The first conveyor belt is wound between the two first rollers. The baffle is arranged at the bottom left of the feeding hopper. The baffle does not contact a left side of the first conveyor belt. The drive motor is arranged on a back side of the mounting frame. An output shaft of the drive motor is connected to the left first roller through a coupling. The deep groove ball bearing is arranged symmetrically from front to back in the middle of a left side of the N-shaped frame. The spindle is arranged between two deep groove ball bearings. The spindle is connected with the cylindrical gear by keying. The N-shaped frame is fixedly connected to the screening device. A gap on the left of the screening device is smaller than a gap on the right of the screening device. The cylindrical gear is located inside the screening device. The guiding device is arranged symmetrically from left to right on the upper part of the mounting frame. The transparent plate is evenly arranged on a front side of the mounting frame. The square hole is opened at the bottom of the mounting frame. The conveyor is arranged symmetrically from left to right on the mounting frame. Two conveyors are respectively located below two guiding devices. The mechanism case is arranged on a top back side of the bottom plate. The first mounting plate is arranged in the middle of an upper side inside the mechanism case. The first mounting plate is symmetrically provided with the first bearing seat from left to right. The first bearing seat is provided with the first drive shaft. The first mounting plate is symmetrically provided with the second bearing seat from left to right. Two second bearing seats are located between two first bearing seats. The second bearing seat is provided with the second drive shaft. A back side of the second drive shaft is connected to the big pulley by keying. The small pulley is connected to a back side of the first drive shaft by keying. A flat belt is wound between a left small pulley and a left big pulley, and a flat belt is wound between a right small pulley and a right big pulley. The servo motor is symmetrically arranged on an upper part of a back wall inside the mechanism case. An output shaft of the servo motor is connected to the back end of the first drive shaft through a coupling. A front end of the first drive shaft is connected to the first gear by keying. The second mounting plate is arranged on a front part of a middle side inside the mechanism case. The second mounting plate is symmetrically provided with a third bearing seat from left to right. Two third bearing seats are both provided with a third drive shaft. A back end of the two third drive shafts is connected to the second gear by keying. The second gear is meshed with the first gear. A front end of the two third drive shafts is connected to the third gear by keying. The fourth bearing seat is symmetrically arranged from left to right on a lower front wall of the mechanism case. The fourth bearing seat is provided with the fourth drive shaft. A back end of two fourth drive shafts is connected to the fourth gear by keying. The fourth gear is meshed with the third gear. The two fourth drive shafts are respectively connected to the two conveyors. The first rotating motor is arranged in the middle of a front wall inside the mechanism case. An output shaft of the first rotating motor is connected to a back end of the spindle through a coupling. The electric threading machine is symmetrically arranged from left to right on a front wall inside the mounting frame.

Further, the conveyor includes a second roller and a second conveyor belt. Two second rollers are symmetrically arranged on the left and right of the mounting frame above the square hole. A second conveyor belt is wound between two second rollers on the left. A second conveyor belt is wound between two second rollers on the right. The second conveyor belt is evenly provided with a chute.

Further, the Radix Codcnopsitis Pilosulas sorting and threading machine includes a fifth bearing seat, a fifth drive shaft, a squeeze roller, a first pinion gear, a second rotating motor, a second pinion gear and a rolling rod. Two fifth bearing seats are symmetrically arranged on each of a front wall and a back wall of an outlet of the feeding hopper. A fifth drive shaft is arranged between two fifth bearing seats on the left. A fifth drive shaft is arranged between two fifth bearing seats on the right. The fifth drive shaft is provided with the squeeze roller. A back end of the fifth drive shaft is connected to a first pinion gear by keying. Two first pinion gears are meshed. The second rotating motor is fixedly arranged on the back wall of the feeding hopper. An output shaft of the second rotating motor is connected to the second pinion gear by keying. The second pinion gear is meshed with a first pinion gear on the left. The rolling rod is evenly arranged on the inner wall of the feeding hopper.

Further, the Radix Codcnopsitis Pilosulas sorting and threading machine includes a straight guide plate and an arc-shaped guide plate. The straight guide plate is fixedly connected to an upper left side of the screening device, and the arc-shaped guide plate is fixedly connected to an upper right side of the screening device.

Further, a threading needle of the electric threading machine is a double-row threading needle.

Further, a gap on the left of the screening device has a size of 2-10 mm, and a gap on the right of the screening device has a size of 11-20 mm.

Further, the feeding hopper is 500 mm long, 500 mm wide and 500 mm high, with an oblique angle of 60°.

Further, the drive motor, the servo motor, the first rotating motor and the second rotating motor are all three-phase asynchronous motors Beneficial effects: The present disclosure realizes rapid screening and automatic threading. In the present disclosure, the rolling rod in the feeding hopper assists the Radix Codcnopsitis Pilosulas to slide down, and the squeeze roller squeezes the Radix Codcnopsitis Pilosulas, thereby reducing the extension range of a rootlet at the tail of the Radix Codcnopsitis Pilosulas. At the same time, the cylindrical gear and the screening device work together to sort the Radix Codcnopsitis Pilosulas by size, and double-row threading effectively stabilizes the Radix Codcnopsitis Pilosulas. The present disclosure prevents the phenomena such as difficult separation, difficult threading and low efficiency due to different sizes and excessive rootlets. The present disclosure ensures effective sorting and threading and improves the efficiency, laying a solid foundation for further drying and early sale of the Radix Codcnopsitis Pilosulas.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Figure 1:
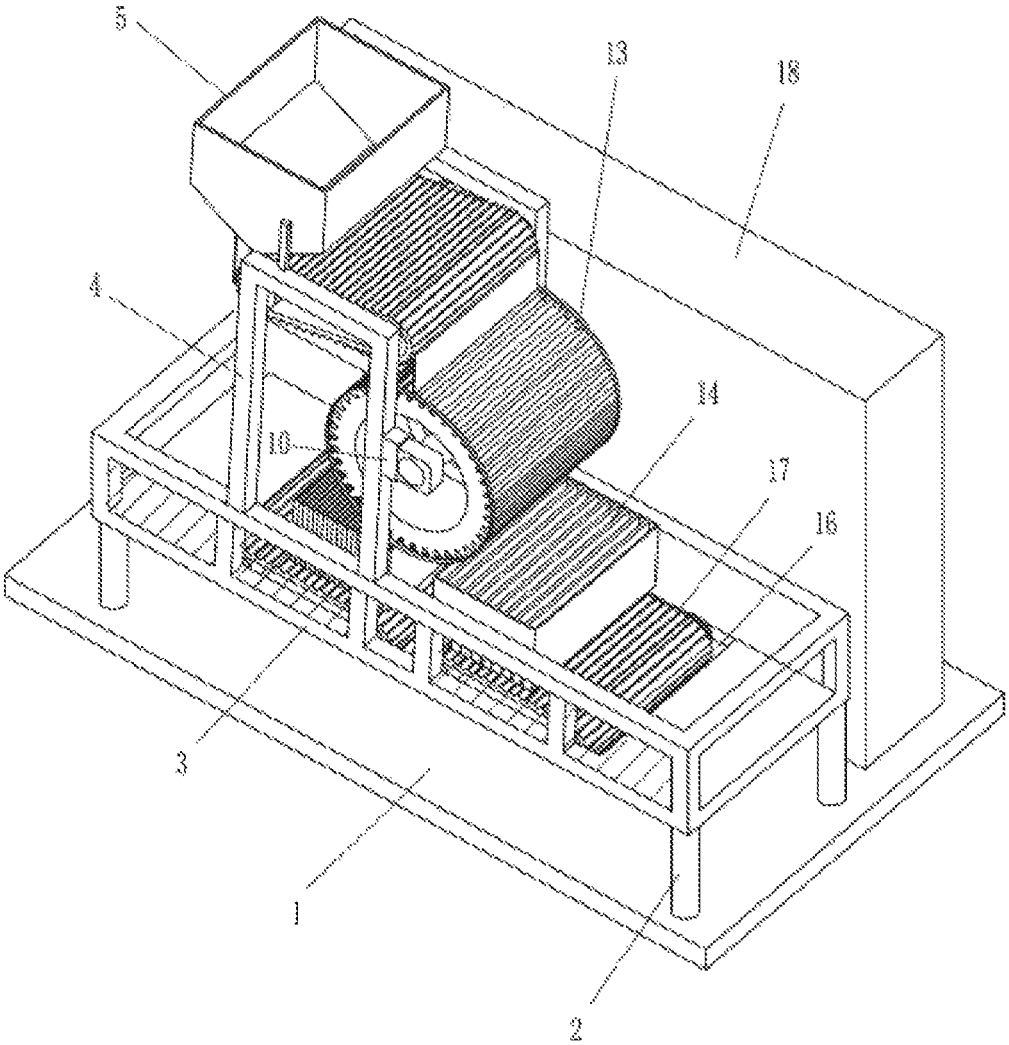
FIG. 1 is a three-dimensional structural diagram of the present disclosure.

Reference numerals: 1. bottom plate, 2. support leg, 3. mounting frame, 4. N-shaped frame, 5. feeding hopper, 6. baffle, 7. first roller, 8. first conveyor belt, 9. drive motor, 10. deep groove ball bearing, 11. spindle, 12. cylindrical gear, 13. screening device, 14. guiding device, 15. transparent plate, 16. square hole, 17. conveyor, 171. second roller, 172. second conveyor belt, 173. chute, 18. mechanism case, 19. first mounting plate, 20. first bearing seat, 21. first drive shaft, 22. second bearing seat, 23. second drive shaft, 24. big pulley, 25. small pulley, 26. flat belt, 27. servo motor, 28. first gear, 29. second mounting plate, 30. third bearing seat, 31. third drive shaft, 32. second gear, 33. third gear, 34. fourth bearing seat, 35. fourth drive shaft, 36. fourth gear, 37. first rotating motor, 38. electric threading machine, 39. fifth bearing seat, 40. fifth drive shaft, 41. squeeze roller, 42. first pinion gear, 43. second rotating motor, 44. second pinion gear, 45. rolling rod, 46. straight guide plate, and 47. arc-shaped guide plate.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

The making and using of the embodiments of this disclosure are discussed in detail below. It should be appreciated, however, that the concepts disclosed herein can be embodied in a wide variety of specific contexts. The specific embodiments discussed are merely illustrative, and do not limit the scope of the claims.

The present disclosure is described in detail below with reference to the accompanying drawings and specific embodiments.

Embodiment 1

Figure 2:
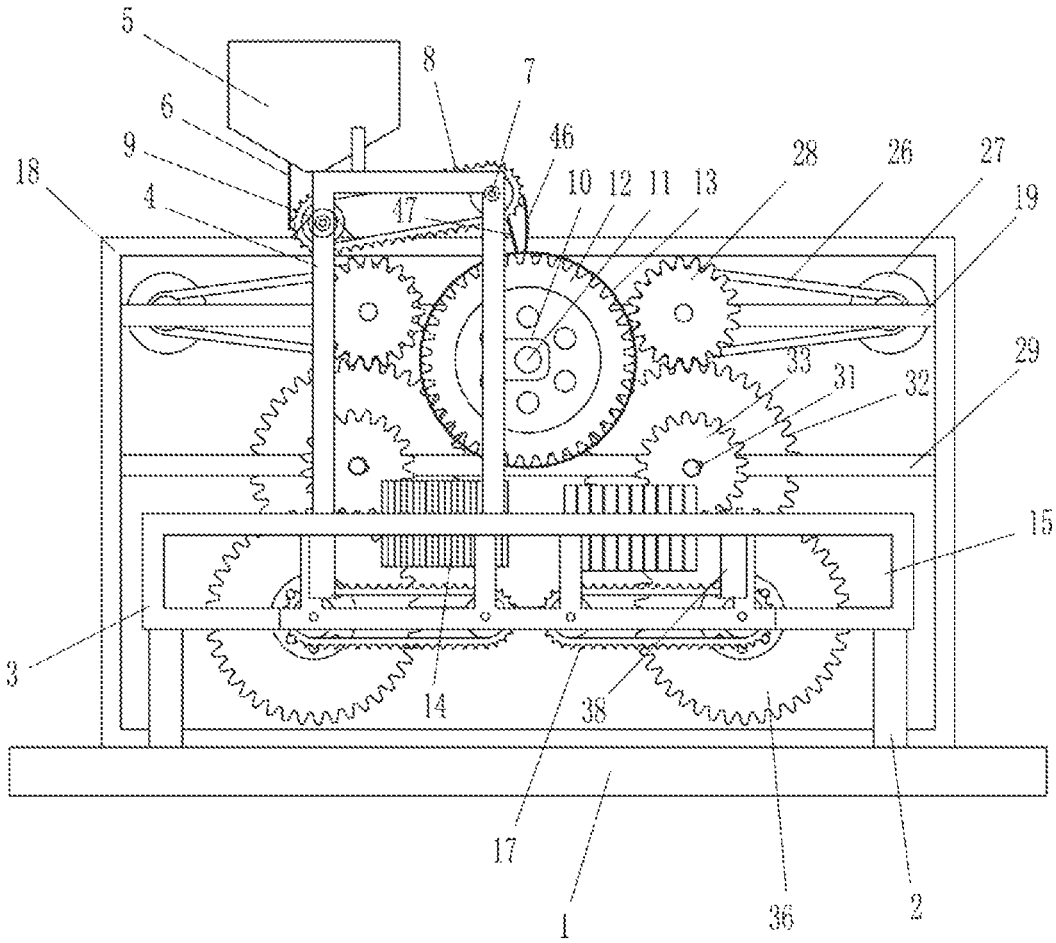
FIG. 2 is a front view of the present disclosure.
Figure 3:
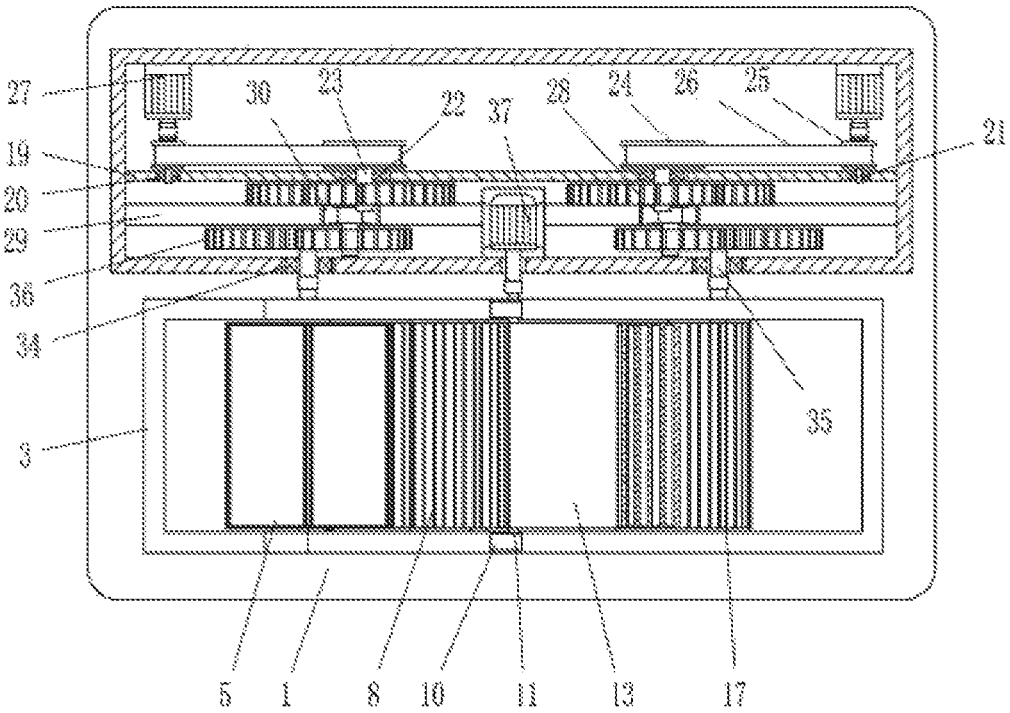
FIG. 3 is a top view of the present disclosure.
Figure 4:
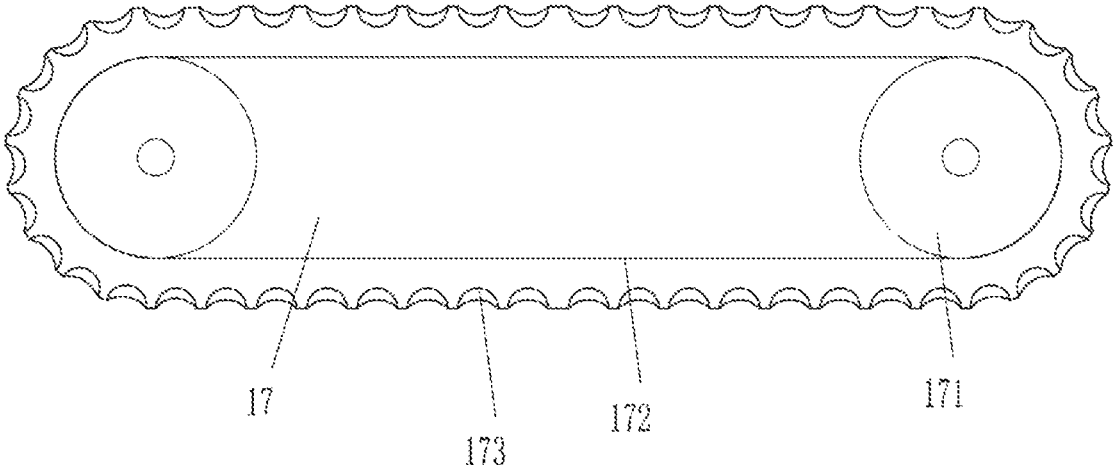
FIG. 4 is a front view of a conveyor of the present disclosure.
Figure 5:
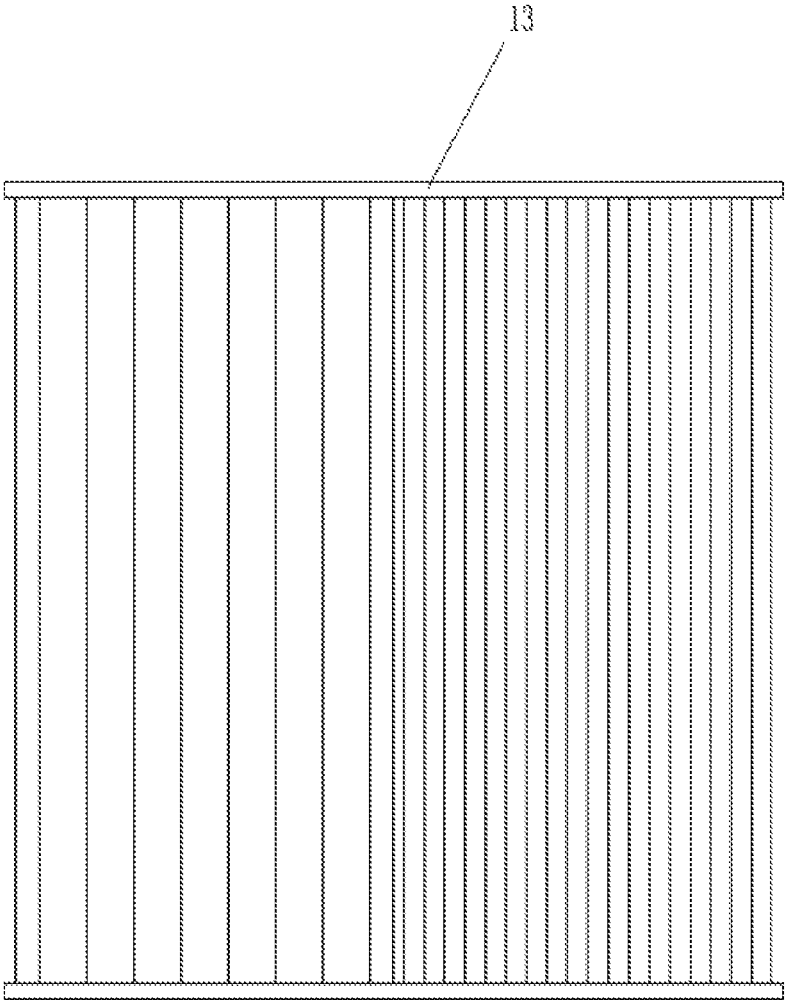
FIG. 5 is a top view of a screening device of the present disclosure.

As shown in FIG. 1 to FIG. 5, a Radix Codcnopsitis Pilosulas sorting and threading machine includes: a bottom plate 1, a support leg 2, a mounting frame 3, an N-shaped frame 4, a feeding hopper 5, a baffle 6, a first roller 7, a first conveyor belt 8, a drive motor 9, a deep groove ball bearing 10, a spindle 11, a cylindrical gear 12, a screening device 13, a guiding device 14, a transparent plate 15, a conveyor 17, a mechanism case 18, a first mounting plate 19, a first bearing seat 20, a first drive shaft 21, a second bearing seat 22, a second drive shaft 23, a big pulley 24, a small pulley 25, a flat belt 26, a servo motor 27, a first gear 28, a second mounting plate 29, a third bearing seat 30, a third drive shaft 31, a second gear 32, a third gear 33, a fourth bearing seat 34, a fourth drive shaft 35, a fourth gear 36, a first rotating motor 37 and an electric threading machine 38. The mounting frame 3 is fixedly mounted on the bottom plate 1 through the support leg 2. The N-shaped frame 4 is mounted on an upper left side of the mounting frame 3. The N-shaped frame 4 is connected to the mounting frame 3 by welding. The feeding hopper 5 is mounted in the top of the mounting frame 3. Two first rollers 7 are rotatably mounted on an upper part of the mounting frame 3. A first roller 7 on the right is higher than a first roller 7 on the left. The first conveyor belt 8 is wound between the two first rollers 7. The baffle 6 is arranged at the bottom left of the feeding hopper 5. The baffle 6 does not contact a left side of the first conveyor belt 8. The drive motor 9 is arranged on a back side of the mounting frame 3. An output shaft of the drive motor 9 is connected to the left first roller 7 through a coupling. The deep groove ball bearing 10 is arranged symmetrically from front to back in the middle of a left side of the N-shaped frame 4. The spindle 11 is arranged between two deep groove ball bearings 10. The spindle 11 is connected with the cylindrical gear 12 by keying. The N-shaped frame 4 is fixedly connected to the screening device 13. The N-shaped frame 4 is connected to the screening device 13 by welding. A gap on the left of the screening device 13 is smaller than a gap on the right of the screening device 13. The cylindrical gear 12 is located inside the screening device 13. The guiding device 14 is arranged symmetrically from left to right on the upper part of the mounting frame 3. The transparent plate 15 is evenly arranged on a front side of the mounting frame 3. The square hole 16 is opened at the bottom of the mounting frame 3. The conveyor 17 is arranged symmetrically from left to right on the mounting frame 3. Two conveyors 17 are respectively located below two guiding devices 14. The mechanism case 18 is arranged on a top back side of the bottom plate 1. The mechanism case 18 is connected to the bottom plate 1 by welding. The first mounting plate 19 is arranged in the middle of an upper side inside the mechanism case 18. The first mounting plate 19 is symmetrically provided with the first bearing seat 20 from left to right. The first bearing seat 20 is provided with the first drive shaft 21. The first mounting plate 19 is symmetrically provided with the second bearing seat 22 from left to right. Two second bearing seats 22 are located between two first bearing seats 20. The second bearing seat 22 is provided with the second drive shaft 23. A back side of the second drive shaft 23 is connected to the big pulley 24 by keying. The small pulley 25 is connected to a back side of the first drive shaft 21 by keying. A flat belt 26 is wound between a left small pulley 25 and a left big pulley 24, and a flat belt 26 is wound between a right small pulley 25 and a right big pulley 24. The servo motor 27 is symmetrically arranged from left to right on an upper part of a back wall inside the mechanism case 18. An output shaft of the servo motor 27 is connected to the back end of the first drive shaft 21 through a coupling. A front end of the first drive shaft 21 is connected to the first gear 28 by keying. The second mounting plate 29 is arranged on a front part of a middle side inside the mechanism case 18. The second mounting plate 29 is symmetrically provided with a third bearing seat 30 from left to right. Two third bearing seats 30 are both provided with a third drive shaft 31. A back end of the two third drive shafts 31 is connected to the second gear 32 by keying. The third drive shaft 31 is connected to the second gear 32 by welding. The second gear 32 is meshed with the first gear 28. A front end of the two third drive shafts 31 is connected to the third gear 33 by keying. The fourth bearing seat 34 is symmetrically arranged from left to right on a lower front wall of the mechanism case 18. The fourth bearing seat 34 is provided with the fourth drive shaft 35. A back end of two fourth drive shafts 35 is connected to the fourth gear 36 by keying. The fourth gear 36 is meshed with the third gear 33. The two fourth drive shafts 35 are respectively connected to the two conveyors 17. The first rotating motor 37 is arranged in the middle of a front wall inside the mechanism case 18. An output shaft of the first rotating motor 37 is connected to a back end of the spindle 11 through a coupling. The electric threading machine 38 is symmetrically arranged from left to right on a front wall inside the mounting frame 3.

Embodiment 2

As shown in FIG. 1 to FIG. 5, a Radix Codcnopsitis Pilosulas sorting and threading machine includes: a bottom plate 1, a support leg 2, a mounting frame 3, an N-shaped frame 4, a feeding hopper 5, a baffle 6, a first roller 7, a first conveyor belt 8, a drive motor 9, a deep groove ball bearing 10, a spindle 11, a cylindrical gear 12, a screening device 13, a guiding device 14, a transparent plate 15, a conveyor 17, a mechanism case 18, a first mounting plate 19, a first bearing seat 20, a first drive shaft 21, a second bearing seat 22, a second drive shaft 23, a big pulley 24, a small pulley 25, a flat belt 26, a servo motor 27, a first gear 28, a second mounting plate 29, a third bearing seat 30, a third drive shaft 31, a second gear 32, a third gear 33, a fourth bearing seat 34, a fourth drive shaft 35, a fourth gear 36, a first rotating motor 37 and an electric threading machine 38. The mounting frame 3 is fixedly mounted on the bottom plate 1 through the support leg 2. The N-shaped frame 4 is mounted on an upper left side of the mounting frame 3. The feeding hopper 5 is mounted in the top of the mounting frame 3. Two first rollers 7 are rotatably mounted on an upper part of the mounting frame 3. A first roller 7 on the right is higher than a first roller 7 on the left. The first conveyor belt 8 is wound between the two first rollers 7. The baffle 6 is arranged at the bottom left of the feeding hopper 5. The baffle 6 does not contact a left side of the first conveyor belt 8. The drive motor 9 is arranged on a back side of the mounting frame 3. An output shaft of the drive motor 9 is connected to the left first roller 7 through a coupling. The deep groove ball bearing 10 is arranged symmetrically from front to back in the middle of a left side of the N-shaped frame 4. The spindle 11 is arranged between two deep groove ball bearings 10. The spindle 11 is connected with the cylindrical gear 12 by keying. The N-shaped frame 4 is fixedly connected to the screening device 13. A gap on the left of the screening device 13 is smaller than a gap on the right of the screening device 13. The cylindrical gear 12 is located inside the screening device 13. The guiding device 14 is arranged symmetrically from left to right on the upper part of the mounting frame 3. The transparent plate 15 is evenly arranged on a front side of the mounting frame 3. The square hole 16 is opened at the bottom of the mounting frame 3. The conveyor 17 is arranged symmetrically from left to right on the mounting frame 3. Two conveyors 17 are respectively located below two guiding devices 14. The mechanism case 18 is arranged on a top back side of the bottom plate 1. The first mounting plate 19 is arranged in the middle of an upper side inside the mechanism case 18. The first mounting plate 19 is symmetrically provided with the first bearing seat 20 from left to right. The first bearing seat 20 is provided with the first drive shaft 21. The first mounting plate 19 is symmetrically provided with the second bearing seat 22 from left to right. Two second bearing seats 22 are located between two first bearing seats 20. The second bearing seat 22 is provided with the second drive shaft 23. A back side of the second drive shaft 23 is connected to the big pulley 24 by keying. The small pulley 25 is connected to a back side of the first drive shaft 21 by keying. A flat belt 26 is wound between a left small pulley 25 and a left big pulley 24, and a flat belt 26 is wound between a right small pulley 25 and a right big pulley 24. The servo motor 27 is symmetrically arranged from left to right on an upper part of a back wall inside the mechanism case 18. An output shaft of the servo motor 27 is connected to the back end of the first drive shaft 21 through a coupling. A front end of the first drive shaft 21 is connected to the first gear 28 by keying. The second mounting plate 29 is arranged on a front part of a middle side inside the mechanism case 18. The second mounting plate 29 is symmetrically provided with a third bearing seat 30 from left to right. Two third bearing seats 30 are both provided with a third drive shaft 31. A back end of the two third drive shafts 31 is connected to the second gear 32 by keying. The second gear 32 is meshed with the first gear 28. A front end of the two third drive shafts 31 is connected to the third gear 33 by keying. The fourth bearing seat 34 is symmetrically arranged from left to right on a lower front wall of the mechanism case 18. The fourth bearing seat 34 is provided with the fourth drive shaft 35. A back end of two fourth drive shafts 35 is connected to the fourth gear 36 by keying. The fourth gear 36 is meshed with the third gear 33. The two fourth drive shafts 35 are respectively connected to the two conveyors 17. The first rotating motor 37 is arranged in the middle of a front wall inside the mechanism case 18. An output shaft of the first rotating motor 37 is connected to a back end of the spindle 11 through a coupling. The electric threading machine 38 is symmetrically arranged from left to right on a front wall inside the mounting frame 3.

The conveyor 17 includes a second roller 171 and a second conveyor belt 172. Two second rollers 171 are symmetrically arranged on the left and right of the mounting frame 3 above the square hole 16. A second conveyor belt 172 is wound between two second rollers 171 on the left. A second conveyor belt 172 is wound between two second rollers 171 on the right. The second conveyor belt 172 is evenly provided with a chute 173.

Embodiment 3

Figure 6:
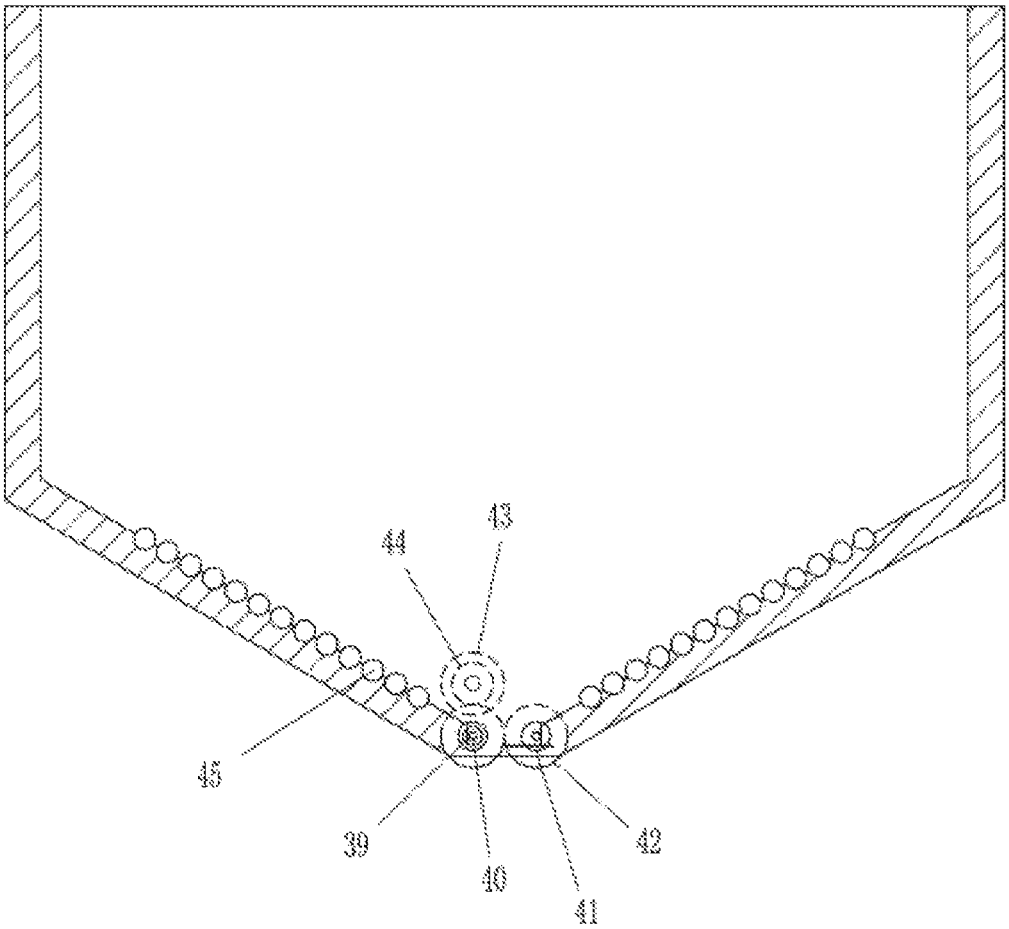
FIG. 6 is a front view of a feeding hopper of the present disclosure.

As shown in FIG. 1 to FIG. 6, a Radix Codcnopsitis Pilosulas sorting and threading machine includes: a bottom plate 1, a support leg 2, a mounting frame 3, an N-shaped frame 4, a feeding hopper 5, a baffle 6, a first roller 7, a first conveyor belt 8, a drive motor 9, a deep groove ball bearing 10, a spindle 11, a cylindrical gear 12, a screening device 13, a guiding device 14, a transparent plate 15, a conveyor 17, a mechanism case 18, a first mounting plate 19, a first bearing seat 20, a first drive shaft 21, a second bearing seat 22, a second drive shaft 23, a big pulley 24, a small pulley 25, a flat belt 26, a servo motor 27, a first gear 28, a second mounting plate 29, a third bearing seat 30, a third drive shaft 31, a second gear 32, a third gear 33, a fourth bearing seat 34, a fourth drive shaft 35, a fourth gear 36, a first rotating motor 37 and an electric threading machine 38. The mounting frame 3 is fixedly mounted on the bottom plate 1 through the support leg 2. The N-shaped frame 4 is mounted on an upper left side of the mounting frame 3. The feeding hopper 5 is mounted in the top of the mounting frame 3. Two first rollers 7 are rotatably mounted on an upper part of the mounting frame 3. A first roller 7 on the right is higher than a first roller 7 on the left. The first conveyor belt 8 is wound between the two first rollers 7. The baffle 6 is arranged at the bottom left of the feeding hopper 5. The baffle 6 does not contact a left side of the first conveyor belt 8. The drive motor 9 is arranged on a back side of the mounting frame 3. An output shaft of the drive motor 9 is connected to the left first roller 7 through a coupling. The deep groove ball bearing 10 is arranged symmetrically from front to back in the middle of a left side of the N-shaped frame 4. The spindle 11 is arranged between two deep groove ball bearings 10. The spindle 11 is connected with the cylindrical gear 12 by keying. The N-shaped frame 4 is fixedly connected to the screening device 13. A gap on the left of the screening device 13 is smaller than a gap on the right of the screening device 13. The cylindrical gear 12 is located inside the screening device 13. The guiding device 14 is arranged symmetrically from left to right on the upper part of the mounting frame 3. The transparent plate 15 is evenly arranged on a front side of the mounting frame 3. The square hole 16 is opened at the bottom of the mounting frame 3. The conveyor 17 is arranged symmetrically from left to right on the mounting frame 3. Two conveyors 17 are respectively located below two guiding devices 14. The mechanism case 18 is arranged on a top back side of the bottom plate 1. The first mounting plate 19 is arranged in the middle of an upper side inside the mechanism case 18. The first mounting plate 19 is symmetrically provided with the first bearing seat 20 from left to right. The first bearing seat 20 is provided with the first drive shaft 21. The first mounting plate 19 is symmetrically provided with the second bearing seat 22 from left to right. Two second bearing seats 22 are located between two first bearing seats 20. The second bearing seat 22 is provided with the second drive shaft 23. A back side of the second drive shaft 23 is connected to the big pulley 24 by keying. The small pulley 25 is connected to a back side of the first drive shaft 21 by keying. A flat belt 26 is wound between a left small pulley 25 and a left big pulley 24, and a flat belt 26 is wound between a right small pulley 25 and a right big pulley 24. The servo motor 27 is symmetrically arranged from left to right on an upper part of a back wall inside the mechanism case 18. An output shaft of the servo motor 27 is connected to the back end of the first drive shaft 21 through a coupling. A front end of the first drive shaft 21 is connected to the first gear 28 by keying. The second mounting plate 29 is arranged on a front part of a middle side inside the mechanism case 18. The second mounting plate 29 is symmetrically provided with a third bearing seat 30 from left to right. Two third bearing seats 30 are both provided with a third drive shaft 31. A back end of the two third drive shafts 31 is connected to the second gear 32 by keying. The second gear 32 is meshed with the first gear 28. A front end of the two third drive shafts 31 is connected to the third gear 33 by keying. The fourth bearing seat 34 is symmetrically arranged from left to right on a lower front wall of the mechanism case 18. The fourth bearing seat 34 is provided with the fourth drive shaft 35. A back end of two fourth drive shafts 35 is connected to the fourth gear 36 by keying. The fourth gear 36 is meshed with the third gear 33. The two fourth drive shafts 35 are respectively connected to the two conveyors 17. The first rotating motor 37 is arranged in the middle of a front wall inside the mechanism case 18. An output shaft of the first rotating motor 37 is connected to a back end of the spindle 11 through a coupling. The electric threading machine 38 is symmetrically arranged from left to right on a front wall inside the mounting frame 3.

The conveyor 17 includes a second roller 171 and a second conveyor belt 172. Two second rollers 171 are symmetrically arranged on the left and right of the mounting frame 3 above the square hole 16. A second conveyor belt 172 is wound between two second rollers 171 on the left. A second conveyor belt 172 is wound between two second rollers 171 on the right. The second conveyor belt 172 is evenly provided with a chute 173.

The Radix Codcnopsitis Pilosulas sorting and threading machine further includes a fifth bearing seat 39, a fifth drive shaft 40, a squeeze roller 41, a first pinion gear 42, a second rotating motor 43, a second pinion gear 44 and a rolling rod 45. Two fifth bearing seats 39 are symmetrically arranged on each of a front wall and a back wall of an outlet of the feeding hopper 5. A fifth drive shaft 40 is arranged between two fifth bearing seats 39 on the left. A fifth drive shaft 40 is arranged between two fifth bearing seats 39 on the right. The fifth drive shaft 40 is provided with the squeeze roller 41. A back end of the fifth drive shaft 40 is connected to a first pinion gear 42 by keying. Two first pinion gears 42 are meshed. The second rotating motor 43 is fixedly arranged on the back wall of the feeding hopper 5. The second rotating motor 43 is connected to the feeding hopper 5 by bolting. An output shaft of the second rotating motor 43 is connected to the second pinion gear 44 by keying. The second pinion gear 44 is meshed with a first pinion gear 42 on the left. The rolling rod 45 is evenly arranged on the inner wall of the feeding hopper 5.

Embodiment 4

As shown in FIG. 1 to FIG. 6, a Radix Codcnopsitis Pilosulas sorting and threading machine includes: a bottom plate 1, a support leg 2, a mounting frame 3, an N-shaped frame 4, a feeding hopper 5, a baffle 6, a first roller 7, a first conveyor belt 8, a drive motor 9, a deep groove ball bearing 10, a spindle 11, a cylindrical gear 12, a screening device 13, a guiding device 14, a transparent plate 15, a conveyor 17, a mechanism case 18, a first mounting plate 19, a first bearing seat 20, a first drive shaft 21, a second bearing seat 22, a second drive shaft 23, a big pulley 24, a small pulley 25, a flat belt 26, a servo motor 27, a first gear 28, a second mounting plate 29, a third bearing seat 30, a third drive shaft 31, a second gear 32, a third gear 33, a fourth bearing seat 34, a fourth drive shaft 35, a fourth gear 36, a first rotating motor 37 and an electric threading machine 38. The mounting frame 3 is fixedly mounted on the bottom plate 1 through the support leg 2. The N-shaped frame 4 is mounted on an upper left side of the mounting frame 3. The feeding hopper 5 is mounted in the top of the mounting frame 3. Two first rollers 7 are rotatably mounted on an upper part of the mounting frame 3. A first roller 7 on the right is higher than a first roller 7 on the left. The first conveyor belt 8 is wound between the two first rollers 7. The baffle 6 is arranged at the bottom left of the feeding hopper 5. The baffle 6 does not contact a left side of the first conveyor belt 8. The drive motor 9 is arranged on a back side of the mounting frame 3. An output shaft of the drive motor 9 is connected to the left first roller 7 through a coupling. The deep groove ball bearing 10 is arranged symmetrically from front to back in the middle of a left side of the N-shaped frame 4. The spindle 11 is arranged between two deep groove ball bearings 10. The spindle 11 is connected with the cylindrical gear 12 by keying. The N-shaped frame 4 is fixedly connected to the screening device 13. A gap on the left of the screening device 13 is smaller than a gap on the right of the screening device 13. The cylindrical gear 12 is located inside the screening device 13. The guiding device 14 is arranged symmetrically from left to right on the upper part of the mounting frame 3. The transparent plate 15 is evenly arranged on a front side of the mounting frame 3. The square hole 16 is opened at the bottom of the mounting frame 3. The conveyor 17 is arranged symmetrically from left to right on the mounting frame 3. Two conveyors 17 are respectively located below two guiding devices 14. The mechanism case 18 is arranged on a top back side of the bottom plate 1. The first mounting plate 19 is arranged in the middle of an upper side inside the mechanism case 18. The first mounting plate 19 is symmetrically provided with the first bearing seat 20 from left to right. The first bearing seat 20 is provided with the first drive shaft 21. The first mounting plate 19 is symmetrically provided with the second bearing seat 22 from left to right. Two second bearing seats 22 are located between two first bearing seats 20. The second bearing seat 22 is provided with the second drive shaft 23. A back side of the second drive shaft 23 is connected to the big pulley 24 by keying. The small pulley 25 is connected to a back side of the first drive shaft 21 by keying. A flat belt 26 is wound between a left small pulley 25 and a left big pulley 24, and a flat belt 26 is wound between a right small pulley 25 and a right big pulley 24. The servo motor 27 is symmetrically arranged from left to right on an upper part of a back wall inside the mechanism case 18. An output shaft of the servo motor 27 is connected to the back end of the first drive shaft 21 through a coupling. A front end of the first drive shaft 21 is connected to the first gear 28 by keying. The second mounting plate 29 is arranged on a front part of a middle side inside the mechanism case 18. The second mounting plate 29 is symmetrically provided with a third bearing seat 30 from left to right. Two third bearing seats 30 are both provided with a third drive shaft 31. A back end of the two third drive shafts 31 is connected to the second gear 32 by keying. The second gear 32 is meshed with the first gear 28. A front end of the two third drive shafts 31 is connected to the third gear 33 by keying. The fourth bearing seat 34 is symmetrically arranged from left to right on a lower front wall of the mechanism case 18. The fourth bearing seat 34 is provided with the fourth drive shaft 35. A back end of two fourth drive shafts 35 is connected to the fourth gear 36 by keying. The fourth gear 36 is meshed with the third gear 33. The two fourth drive shafts 35 are respectively connected to the two conveyors 17. The first rotating motor 37 is arranged in the middle of a front wall inside the mechanism case 18. An output shaft of the first rotating motor 37 is connected to a back end of the spindle 11 through a coupling. The electric threading machine 38 is symmetrically arranged from left to right on a front wall inside the mounting frame 3.

The conveyor 17 includes a second roller 171 and a second conveyor belt 172. Two second rollers 171 are symmetrically arranged on the left and right of the mounting frame 3 above the square hole 16. A second conveyor belt 172 is wound between two second rollers 171 on the left. A second conveyor belt 172 is wound between two second rollers 171 on the right. The second conveyor belt 172 is evenly provided with a chute 173.

The Radix Codcnopsitis Pilosulas sorting and threading machine further includes a fifth bearing seat 39, a fifth drive shaft 40, a squeeze roller 41, a first pinion gear 42, a second rotating motor 43, a second pinion gear 44 and a rolling rod 45. Two fifth bearing seats 39 are symmetrically arranged on each of a front wall and a back wall of an outlet of the feeding hopper 5. A fifth drive shaft 40 is arranged between two fifth bearing seats 39 on the left. A fifth drive shaft 40 is arranged between two fifth bearing seats 39 on the right. The fifth drive shaft 40 is provided with the squeeze roller 41. A back end of the fifth drive shaft 40 is connected to a first pinion gear 42 by keying. Two first pinion gears 42 are meshed. The second rotating motor 43 is fixedly arranged on the back wall of the feeding hopper 5. An output shaft of the second rotating motor 43 is connected to the second pinion gear 44 by keying. The second pinion gear 44 is meshed with a first pinion gear 42 on the left. The rolling rod 45 is evenly arranged on the inner wall of the feeding hopper 5.

Further, the Radix Codcnopsitis Pilosulas sorting and threading machine includes a straight guide plate 46 and an arc-shaped guide plate 47. The straight guide plate 46 is fixedly connected to an upper left side of the screening device 13. The straight guide plate 46 is connected to the screening device 13 by welding. The arc-shaped guide plate 47 is fixedly connected to an upper right side of the screening device 13.

Embodiment 5

As shown in FIG. 1 to FIG. 6, a Radix Codcnopsitis Pilosulas sorting and threading machine includes: a bottom plate 1, a support leg 2, a mounting frame 3, an N-shaped frame 4, a feeding hopper 5, a baffle 6, a first roller 7, a first conveyor belt 8, a drive motor 9, a deep groove ball bearing 10, a spindle 11, a cylindrical gear 12, a screening device 13, a guiding device 14, a transparent plate 15, a conveyor 17, a mechanism case 18, a first mounting plate 19, a first bearing seat 20, a first drive shaft 21, a second bearing seat 22, a second drive shaft 23, a big pulley 24, a small pulley 25, a flat belt 26, a servo motor 27, a first gear 28, a second mounting plate 29, a third bearing seat 30, a third drive shaft 31, a second gear 32, a third gear 33, a fourth bearing seat 34, a fourth drive shaft 35, a fourth gear 36, a first rotating motor 37 and an electric threading machine 38. The mounting frame 3 is fixedly mounted on the bottom plate 1 through the support leg 2. The N-shaped frame 4 is mounted on an upper left side of the mounting frame 3. The feeding hopper 5 is mounted in the top of the mounting frame 3. Two first rollers 7 are rotatably mounted on an upper part of the mounting frame 3. A first roller 7 on the right is higher than a first roller 7 on the left. The first conveyor belt 8 is wound between the two first rollers 7. The baffle 6 is arranged at the bottom left of the feeding hopper 5. The baffle 6 does not contact a left side of the first conveyor belt 8. The drive motor 9 is arranged on a back side of the mounting frame 3. An output shaft of the drive motor 9 is connected to the left first roller 7 through a coupling. The deep groove ball bearing 10 is arranged symmetrically from front to back in the middle of a left side of the N-shaped frame 4. The spindle 11 is arranged between two deep groove ball bearings 10. The spindle 11 is connected with the cylindrical gear 12 by keying. The N-shaped frame 4 is fixedly connected to the screening device 13. A gap on the left of the screening device 13 is smaller than a gap on the right of the screening device 13. The cylindrical gear 12 is located inside the screening device 13. The guiding device 14 is arranged symmetrically from left to right on the upper part of the mounting frame 3. The transparent plate 15 is evenly arranged on a front side of the mounting frame 3. The square hole 16 is opened at the bottom of the mounting frame 3. The conveyor 17 is arranged symmetrically from left to right on the mounting frame 3. Two conveyors 17 are respectively located below two guiding devices 14. The mechanism case 18 is arranged on a top back side of the bottom plate 1. The first mounting plate 19 is arranged in the middle of an upper side inside the mechanism case 18. The first mounting plate 19 is symmetrically provided with the first bearing seat 20 from left to right. The first bearing seat 20 is provided with the first drive shaft 21. The first mounting plate 19 is symmetrically provided with the second bearing seat 22 from left to right. Two second bearing seats 22 are located between two first bearing seats 20. The second bearing seat 22 is provided with the second drive shaft 23. A back side of the second drive shaft 23 is connected to the big pulley 24 by keying. The small pulley 25 is connected to a back side of the first drive shaft 21 by keying. A flat belt 26 is wound between a left small pulley 25 and a left big pulley 24, and a flat belt 26 is wound between a right small pulley 25 and a right big pulley 24. The servo motor 27 is symmetrically arranged from left to right on an upper part of a back wall inside the mechanism case 18. An output shaft of the servo motor 27 is connected to the back end of the first drive shaft 21 through a coupling. A front end of the first drive shaft 21 is connected to the first gear 28 by keying. The second mounting plate 29 is arranged on a front part of a middle side inside the mechanism case 18. The second mounting plate 29 is symmetrically provided with a third bearing seat 30 from left to right. Two third bearing seats 30 are both provided with a third drive shaft 31. A back end of the two third drive shafts 31 is connected to the second gear 32 by keying. The second gear 32 is meshed with the first gear 28. A front end of the two third drive shafts 31 is connected to the third gear 33 by keying. The fourth bearing seat 34 is symmetrically arranged from left to right on a lower front wall of the mechanism case 18. The fourth bearing seat 34 is provided with the fourth drive shaft 35. A back end of two fourth drive shafts 35 is connected to the fourth gear 36 by keying. The fourth gear 36 is meshed with the third gear 33. The two fourth drive shafts 35 are respectively connected to the two conveyors 17. The first rotating motor 37 is arranged in the middle of a front wall inside the mechanism case 18. An output shaft of the first rotating motor 37 is connected to a back end of the spindle 11 through a coupling. The electric threading machine 38 is symmetrically arranged from left to right on a front wall inside the mounting frame 3.

The conveyor 17 includes a second roller 171 and a second conveyor belt 172. Two second rollers 171 are symmetrically arranged on the left and right of the mounting frame 3 above the square hole 16. A second conveyor belt 172 is wound between two second rollers 171 on the left. A second conveyor belt 172 is wound between two second rollers 171 on the right. The second conveyor belt 172 is evenly provided with a chute 173.

The Radix Codcnopsitis Pilosulas sorting and threading machine further includes a fifth bearing seat 39, a fifth drive shaft 40, a squeeze roller 41, a first pinion gear 42, a second rotating motor 43, a second pinion gear 44 and a rolling rod 45. Two fifth bearing seats 39 are symmetrically arranged on each of a front wall and a back wall of an outlet of the feeding hopper 5. A fifth drive shaft 40 is arranged between two fifth bearing seats 39 on the left. A fifth drive shaft 40 is arranged between two fifth bearing seats 39 on the right. The fifth drive shaft 40 is provided with the squeeze roller 41. A back end of the fifth drive shaft 40 is connected to a first pinion gear 42 by keying. Two first pinion gears 42 are meshed. The second rotating motor 43 is fixedly arranged on the back wall of the feeding hopper 5. An output shaft of the second rotating motor 43 is connected to the second pinion gear 44 by keying. The second pinion gear 44 is meshed with a first pinion gear 42 on the left. The rolling rod 45 is evenly arranged on the inner wall of the feeding hopper 5.

The Radix Codcnopsitis Pilosulas sorting and threading machine further includes a straight guide plate 46 and an arc-shaped guide plate 47. The straight guide plate 46 is fixedly connected to an upper left side of the screening device 13, and the arc-shaped guide plate 47 is fixedly connected to an upper right side of the screening device 13.

A threading needle of the electric threading machine 38 is a double-row threading needle.

A gap on the left of the screening device 13 has a size of 2-10 mm, and a gap on the right of the screening device 13 has a size of 11-20 mm.

The feeding hopper is 500 mm 5 long, 500 mm wide and 500 mm high, with an oblique angle of 60°.

The drive motor 9, the servo motor 27, the first rotating motor 37 and the second rotating motor 43 are all three-phase asynchronous motors.

When this equipment is used for sorting and threading a Radix Codcnopsitis Pilosulas, a worker starts the drive motor 9, the servo motor 27 and the first rotating motor 37. The drive motor 9 drives the first roller 7 to rotate clockwise, and then drives the first conveyor belt 8 to rotate. The worker places the Radix Codcnopsitis Pilosulas in the feeding hopper 5. The Radix Codcnopsitis Pilosulas in the feeding hopper 5 drops onto the first conveyor belt 8, and the dropped Radix Codcnopsitis Pilosulas will slide into an empty groove of the first conveyor belt 8. The Radix Codcnopsitis Pilosulas stacked in the empty groove will slide leftward to the next empty groove. The baffle plate 6 prevents the Radix Codcnopsitis Pilosulas from dropping out from the left. The first conveyor belt 8 drives the Radix Codcnopsitis Pilosulas to the right to drop into a gear groove of the cylindrical gear 12. The first rotating motor 37 drives the cylindrical gear 12 to rotate counterclockwise. When the cylindrical gear is rotated to 45°, the Radix Codcnopsitis Pilosulas contacts the screening device 13. A small Radix Codcnopsitis Pilosulas drops from the left of the screening device 13 into the left guiding device 14 and enters into the left conveyor 17. A large Radix Codcnopsitis Pilosulas continuously moves counterclockwise along the cylindrical gear 12. When rotating to the right, the large Radix Codcnopsitis Pilosulas drops from the left of the screening device 13 into the right guiding device 14 and enters into the right conveyor 17. In this way, the Radix Codcnopsitis Pilosulas is sorted according to their size. The left servo motor 27 drives the left small pulley 25 to rotate counterclockwise. The left small pulley 25 drives the left big pulley 24 to rotate counterclockwise through the left flat belt 26, and then drives the left first gear 28 to rotate counterclockwise. The left first gear 28 drives the left second gear 32 to rotate clockwise. The left second gear 32 drives the left third gear 33 to rotate clockwise. The left third gear 33 drives the left fourth gear 36 to rotate counterclockwise, and then drives the left conveyor 17 to convey leftward. The left conveyor 17 conveys the left Radix Codcnopsitis Pilosulas leftward. When the Radix Codcnopsitis Pilosulas is conveyed to a lower side of the electric threading machine 38, the electric threading machine 38 threads the Radix Codcnopsitis Pilosulas. After the threading is completed, the Radix Codcnopsitis Pilosulas continues to move leftward, and the electric threading machine continues to thread the next Radix Codcnopsitis Pilosulas. The worker can cut the Radix Codcnopsitis Pilosulas off at a 40 cm distance from a threaded part, and tie the Radix Codcnopsitis Pilosulas with a tape for collection. Similarly, the right servo motor 27 rotates clockwise, and the right conveyor 17 conveys the Radix Codcnopsitis Pilosulas rightward to complete the threading of the Radix Codcnopsitis Pilosulas. The present disclosure has a novel structure and a low cost. In addition, the present disclosure reduces the workload of the worker, and improves the efficiency of threading the Radix Codcnopsitis Pilosulas.

After the Radix Codcnopsitis Pilosulas drops into the chute 173 on the second conveyor belt 172, the Radix Codcnopsitis Pilosulas slides forward with a head down to contact the transparent plate 15 on the mounting frame 3. The second conveyor belt 172 drives the Radix Codcnopsitis Pilosulas to move to the electric threading machine 38 for threading. In this way, it is possible to thread the Radix Codcnopsitis Pilosulas neatly.

The worker controls the second rotating motor 43 to rotate counterclockwise. The second rotating motor 43 drives the second pinion gear 44 to rotate counterclockwise. The second pinion gear 44 drives the left first pinion gear 42 to rotate clockwise. The left first pinion gear 42 drives the left squeeze roller 41 to rotate clockwise through the left fifth drive shaft 40. The left first pinion gear 42 drives the right first pinion gear 42 to rotate counterclockwise, so that the right squeeze roller 41 rotates clockwise. The rolling rod 45 in the feeding hopper 5 facilitates the Radix Codcnopsitis Pilosulas to slide toward the outlet. When the Radix Codcnopsitis Pilosulas drops, it is squeezed by two squeeze rollers 41. This design reduces the extension range of a rootlet at the tail of the Radix Codcnopsitis Pilosulas, and prevents the phenomena such as difficult separation, difficult threading and low efficiency due to different sizes and excessive rootlets. Therefore, the present disclosure ensures effective threading and improves the efficiency of threading the Radix Codcnopsitis Pilosulas.

The straight guide plate 46 and the arc-shaped guide plate 47 guide the dropping Radix Codcnopsitis Pilosulas to ensure that the Radix Codcnopsitis Pilosulas drops into the gear groove of the cylindrical gear 12 accurately.

The threading needle of the electric threading machine 38 is a double-row threading needle. The needle threads the Radix Codcnopsitis Pilosulas with double rows to effectively stabilize the Radix Codcnopsitis Pilosulas.

The drive motor 9, the servo motor 27, the first rotating motor 37 and the second rotating motor 43 are all three-phase asynchronous motors. The three-phase asynchronous motors have a compact structure, a low price, simple maintenance, low noise, and safe and reliable operation.

Those skilled in the art should understand that the above embodiments are not intended to limit the present disclosure in any form, and that any technical solutions obtained by means of equivalent replacement or equivalent transformation should fall within the protection scope of the present disclosure.

Although embodiments of the present disclosure have been described in detail, it should be understood that various changes, substitutions and alterations can be made herein without departing from the spirit and scope of the disclosure as defined by the appended claims.

Moreover, the scope of the present disclosure is not intended to be limited to the particular embodiments described here. As one of ordinary skill in the art will readily appreciate from the disclosure of the present disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed:

1. A Radix Codcnopsitis Pilosulas sorting and threading machine, comprising: a bottom plate (1), a support leg (2), a mounting frame (3), an N-shaped frame (4), a feeding hopper (5), a baffle (6), two first rollers (7), a first conveyor belt (8), a drive motor (9), two deep groove ball bearings (10), a spindle (11), a cylindrical gear (12), a screening device (13), two guiding devices (14) and a transparent plate (15), wherein the mounting frame (3) is fixedly mounted on the bottom plate (1) through the support leg (2); the N-shaped frame (4) is mounted on an upper left side of the mounting frame (3); the feeding hopper (5) is mounted in the top of the mounting frame (3); the two first rollers (7) are rotatably mounted on an upper part of the mounting frame (3), a right roller of the two first rollers (7) on the right is higher than a left roller of the two first rollers (7) on the left; the first conveyor belt (8) is wound between the two first rollers (7); the baffle (6) is arranged at a bottom left of the feeding hopper (5); the baffle (6) does not contact a left side of the first conveyor belt (8); the drive motor (9) is arranged on a back side of the mounting frame (3); an output shaft of the drive motor (9) is connected to the left roller (7) through a coupling; the two deep groove ball bearings (10) are arranged symmetrically from front to back in a middle of a left side of the N-shaped frame (4); the spindle (11) is arranged between the two deep groove ball bearings (10); the spindle (11) is connected with the cylindrical gear (12) by keying; the N-shaped frame (4) is fixedly connected to the screening device (13); a gap on a left of the screening device (13) is smaller than a gap on a right of the screening device (13); the cylindrical gear (12) is located inside the screening device (13); the two guiding devices (14) are arranged symmetrically from left to right on the upper part of the mounting frame (3); the transparent plate (15) is evenly arranged on a front side of the mounting frame (3); a square hole (16) is opened at the bottom of the mounting frame (3); wherein the Radix Codcnopsitis Pilosulas sorting and threading machine further comprises two conveyors (17), a mechanism case (18), a first mounting plate (19), two first bearing seats (20), first drive shafts (21), two second bearing seats (22), second drive shafts (23), big pulleys (24), small pulleys (25), flat belts (26), servo motors (27), first gears (28), a second mounting plate (29), two third bearing seats (30), third drive shafts (31), second gears (32), third gears (33), two fourth bearing seats (34), two fourth drive shafts (35), fourth gears (36), a first rotating motor (37) and electric threading machines (38); the two conveyors (17) are arranged symmetrically from left to right on the mounting frame (3); the two conveyors (17) are respectively located below the two guiding devices (14); the mechanism case (18) is arranged on a top back side of the bottom plate (1); the first mounting plate (19) is arranged in a middle of an upper side inside the mechanism case (18); the first mounting plate (19) is symmetrically provided with the two first bearing seats (20) from left to right; the two first bearing seats (20) are provided with the first drive shafts (21) respectively; the first mounting plate (19) is symmetrically provided with the two second bearing seats (22) from left to right; the two second bearing seats (22) are located between the two first bearing seats (20); the two second bearing seats (22) are provided with the second drive shafts (23) respectively; a back side of each second drive (23) is connected to corresponding one of the big pulleys (24) by keying; each small (25) is connected to a back side of corresponding one of the first drive shafts (21) by keying; one of the flat belts (26) is wound between a left one of the small pulleys (25) and a left one of the big pulleys (24), and another of the flat belts (26) is wound between a right one of the small pulleys (25) and a right one of the big pulleys (24); the servo motors (27) are symmetrically arranged from left to right on an upper part of a back wall inside the mechanism case (18); an output shaft of each servo motor (27) is connected to the back end of corresponding one of the first drive shafts (21) through a coupling; a front end of each first drive (21) is connected to corresponding one of the first gears (28) by keying; the second mounting plate (29) is arranged on a front part of a middle side inside the mechanism case (18); the second mounting plate (29) is symmetrically provided with the two third bearing seats (30) from left to right; the two third bearing seats (30) are provided with respective third drive shafts (31); back ends of the two third drive shafts (31) are respectively connected to the second gears (32) by keying; the second gears (32) are meshed with the first gears (28); front ends of the two third drive shafts (31) are connected to respective third gears (33) by keying; the two fourth bearing seats (34) are symmetrically arranged from left to right on a lower front wall of the mechanism case (18); the two fourth bearing seats (34) are respectively provided with the two fourth drive shafts (35); back ends of the two fourth drive shafts (35) are connected to respective fourth gears (36) by keying; the fourth gears (36) are meshed with the third gears (33); the two fourth drive shafts (35) are respectively connected to the two conveyors (17); the first rotating motor (37) is arranged in a middle of a front wall inside the mechanism case (18); an output shaft of the first rotating motor (37) is connected to a back end of the spindle (11) through a coupling; the electric threading machines (38) are symmetrically arranged from left to right on a front wall inside the mounting frame (3).

2. The Radix Codcnopsitis Pilosulas sorting and threading machine according to claim 1, wherein the two conveyors (17) each comprise two second rollers (171) and a second conveyor belt (172); the two second rollers (171) are symmetrically arranged on left and right of the mounting frame (3) above the square hole (16); the second conveyor belt (172) is wound between the two second rollers (171) the second conveyor belt (172) is evenly provided with a chute (173).

3. The Radix Codcnopsitis Pilosulas sorting and threading machine according to claim 2, further comprising two fifth bearing seats (39), a fifth drive shaft (40), a squeeze roller (41), two first pinion gears (42), a second rotating motor (43), a second pinion gear (44) and a rolling rod (45), wherein the two fifth bearing seats (39) are symmetrically arranged on each of a front wall and a back wall of an outlet of the feeding hopper (5); the fifth drive (40) is arranged between the two fifth bearing seats (39) on the left the fifth drive (40) is provided with the squeeze roller (41); a back end of the fifth drive (40) is connected to the first pinion gears (42) by keying; the two first pinion gears (42) are meshed; the second rotating motor (43) is fixedly arranged on the back wall of the feeding hopper (5); an output shaft of the second rotating motor (43) is connected to the second pinion gear (44) by keying; the second pinion gear (44) is meshed with one of the two first pinion gears (42) on the left; the rolling rod (45) is evenly arranged on inner walls of the feeding hopper (5).

4. The Radix Codcnopsitis Pilosulas sorting and threading machine according to claim 3, further comprising a straight guide plate (46) and an arc-shaped guide plate (47), wherein the straight guide plate (46) is fixedly connected to an upper left side of the screening device (13), and the arc-shaped guide plate (47) is fixedly connected to an upper right side of the screening device (13).

5. The Radix Codcnopsitis Pilosulas sorting and threading machine according to claim 4, wherein a threading needle of each electric threading machine (38) is a double-row threading needle.

6. The Radix Codcnopsitis Pilosulas sorting and threading machine according to claim 5, wherein a gap on a left of the screening device (13) has a size of 2-10 mm, and a gap on a right of the screening device (13) has a size of 11-20 mm.

7. The Radix Codcnopsitis Pilosulas sorting and threading machine according to claim 6, wherein the feeding hopper (5) is 500 mm long, 500 mm wide and 500 mm high, with an oblique angle of 60°.

8. The Radix Codcnopsitis Pilosulas sorting and threading machine according to claim 7, wherein the drive motor (9), the servo motors (27), the first rotating motor (37) and the second rotating motor (43) are all three-phase asynchronous motors.

* * * * *